US009393667B2

(12) United States Patent
Boeck et al.

(10) Patent No.: US 9,393,667 B2
(45) Date of Patent: Jul. 19, 2016

(54) HANDHELD POWER TOOL

(71) Applicant: Robert Bosch GmbH, Stuttgart (DE)

(72) Inventors: Cornelius Boeck, Kirchheim (DE); Joachim Schadow, Stuttgart (DE); Joerg Maute, Sindelfingen (DE); Florian Esenwein, Leinfelden-Echterdingen (DE); Manfred Lutz, Filderstadt (DE); Daniel Barth, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 168 days.

(21) Appl. No.: 14/187,199

(22) Filed: Feb. 21, 2014

(65) Prior Publication Data

US 2014/0242890 A1 Aug. 28, 2014

(30) Foreign Application Priority Data

Feb. 22, 2013 (DE) ..... 10 2013 202 964

(51) Int. Cl.
*B24B 47/12* (2006.01)
*B24B 23/02* (2006.01)

(52) U.S. Cl.
CPC ..... *B24B 47/12* (2013.01); *B24B 23/028* (2013.01)

(58) Field of Classification Search
CPC ..... B24B 23/00; B24B 23/02; B24B 23/028; B24B 47/12; B24B 47/18; B25F 5/00; B25F 5/001; B25F 5/003; B25F 5/005; B25F 5/006; B25F 5/008
See application file for complete search history.

(56) References Cited

U.S. PATENT DOCUMENTS

| | | | | |
|---|---|---|---|---|
| 8,796,964 | B2 * | 8/2014 | Dietl | B25F 5/00 318/400.07 |
| 9,085,076 | B2 * | 7/2015 | Zhamu | B25F 5/00 |
| 2008/0297080 | A1 * | 12/2008 | Bosch | B25B 21/008 318/400.09 |
| 2011/0273118 | A1 * | 11/2011 | Bonner | H02M 1/4225 318/400.3 |
| 2012/0175357 | A1 * | 7/2012 | Magerl | B23K 9/1043 219/137 R |
| 2014/0242888 | A1 * | 8/2014 | Boeck | B24B 23/028 451/358 |
| 2015/0217422 | A1 * | 8/2015 | Esenwein | B24B 23/04 173/217 |

FOREIGN PATENT DOCUMENTS

| | | | |
|---|---|---|---|
| DE | 10 2008 000 704 | A1 | 10/2008 |
| JP | 2008-125296 | A | 5/2008 |

* cited by examiner

*Primary Examiner* — Timothy V Eley
(74) *Attorney, Agent, or Firm* — Maginot, Moore & Beck LLP

(57) ABSTRACT

An angle grinder including at least one boost mode unit configured to provide a boost mode, and a switching-over unit configured to switch over between a conventional mode and the boost mode.

6 Claims, 2 Drawing Sheets

HANDHELD POWER TOOL

This application claims priority under 35 U.S.C. §119 to patent application no. DE 10 2013 202 964.0, filed on Feb. 22, 2013 in Germany, the disclosure of which is incorporated herein by reference in its entirety.

BACKGROUND

Handheld power tools, such as angle grinders, are known in the prior art.

SUMMARY

The disclosure is based on a handheld power tool, in particular an angle grinder.

It is proposed that the handheld power tool comprises at least one boost mode unit, which is intended for providing a boost mode. A "boost mode" should be understood in this connection as meaning in particular an operating mode of the handheld power tool in which a power output of the drive unit in particular of at least 130%, preferably of at least 140%, with preference of at least 150% and with particular preference of at least 160% of a nominal power output of the drive unit is made available, at least for a time. In a particularly preferred exemplary embodiment, in the boost mode a power output of the drive unit that is at least 180% of the nominal power output of the drive unit can be made available for a short time. "For a short time" should be understood in this connection as meaning in particular less than 60 s, preferably less than 45 s, with preference less than 30 s and with particular preference less than 15 s. "Intended" should be understood as meaning in particular specially programmed, designed, configured and/or equipped.

The configuration according to the disclosure allows an advantageously powerful, operator-friendly and versatile handheld power tool to be achieved.

It is also proposed that the handheld power tool has a switching-over unit, which is intended for switching over at least between a conventional mode and the boost mode. A "conventional mode" should be understood in this connection as meaning in particular an operating state which corresponds at least partially, preferably at least for the most part and with particular preference at least almost completely to an operating and/or working mode of an already known handheld power tool and which is intended for making continuous operation of the handheld power tool possible. Preferably, in the conventional operating mode a maximum power output of the drive unit which corresponds in particular by at least 80%, preferably at least 90%, with preference at least 100% and with particular preference at least 110% to a nominal power output of the drive unit is made available. In the conventional operating mode, the maximum power output of the drive unit is in particular at most 120% of the nominal power output of the drive unit. In the conventional operating mode, the handheld power tool preferably has in an operating and/or working state a maximum retrievable energy consumption which is in particular less than 95%, preferably less than 90%, with preference less than 85% and with particular preference less than 80% of a maximum retrievable energy consumption of the handheld power tool in an operating and/or working state in a boost mode, while the type of operation is identical and/or at least comparable. In the conventional mode, the handheld power tool may make a lower power output available in an operating and/or working state than in a boost mode. As a result, a handheld power tool which with preference can be used flexibly and is adapted to a respective application can be achieved.

What is more, it is proposed that the handheld power tool has a sensor unit, which is intended for sensing at least one operating parameter at least in the boost mode. The operating parameter may be formed in particular by a temperature, a rotational speed, a power take-up, a time period, and/or some other characteristic variable of the handheld power tool that appears to be appropriate to a person skilled in the art, in particular in an operating state. As a result, operation of the handheld power tool which is with preference inexpensive, powerful and consequently operator-friendly can be achieved in an advantageously easy way.

Moreover, it is proposed that the sensor unit is at least partially coupled to the boost mode unit. "Coupled" should be understood in this connection as meaning in particular that two components are formed at least partially as connected to one another, in particular for a transmission of information. The boost mode unit is preferably coupled to the sensor unit electronically. As a result, a preferred high level of operator convenience can be achieved.

Furthermore, it is proposed that the boost mode unit comprises at least one open-loop and/or closed-loop control unit, which is intended for open-loop and/or closed-loop control of at least one drive unit. "Open-loop and/or closed-loop control" should be understood in this connection as meaning in particular a process that is at least partially independent of an operating state of the drive unit and/or of an electronics unit and is at least partially intended for at least partially actively influencing operation at least of the drive unit and/or at least partially adapting and/or approximating the operation of the drive unit to a prescribed sequence and/or in particular changing, in particular actively changing, dynamically variable operating parameters of the drive unit, preferably in a way corresponding to an algorithm. The open-loop and/or closed-loop control unit may in particular be at least partially mechanically formed, with particular preference at least partially electronically formed. Preferably, the open-loop and/or closed-loop control unit additionally has a computing unit and in particular, in addition to the computing unit, a memory unit with an open-loop and/or closed-loop control program stored therein, which is intended for being performed by the computing unit. In a particularly preferred exemplary embodiment, an open-loop and/or closed-loop control unit is at least partially formed in one piece with the electronics unit, with software and/or firmware of the electronics unit at least partially being intended for open-loop and/or closed-loop control and/or for switching over between the operating modes.

A "drive unit" should be understood in this connection as meaning in particular a unit which is intended for driving an insert tool coupled to the handheld power tool in an operating state. The drive unit preferably comprises at least one electric motor. However, it is also conceivable that the drive unit is at least partially formed such that it can be driven pneumatically and/or can be driven in some other way that appears appropriate to a person skilled in the art. An "electronics unit" should be understood in this connection as meaning in particular a unit which is intended at least partially for open-loop and/or closed-loop control, in particular of the drive unit of the handheld power tool, at least in an operating state of the handheld power tool. Preferably, the electronics unit comprises at least one motor controller of the drive unit. The electronics unit preferably has electronic components, such as in particular at least one transistor, at least one capacitor, at least one processor, with particular preference at least one field-effect transistor (MOSFET) and/or at least one bipolar transistor, in particular with an insulated gate electrode (IGBT). As a result, an advantageously powerful, operator-friendly and versatile handheld power tool can be achieved.

Moreover, it is proposed that the open-loop and/or closed-loop control unit is intended for controlling the boost mode unit in an open-loop or closed-loop manner at least in dependence on the operating parameter. As a result, a handheld power tool which is advantageously powerful and is adapted to a respective application can be achieved in an advantageously easy way.

What is more, it is proposed that the drive unit comprises at least one EC motor. An "EC motor" should be understood in this connection as meaning in particular a brushless, electrically commutated motor. As a result, a configuration of the drive unit of the handheld power tool that is with preference powerful, advantageously compact and inexpensive can be achieved.

Furthermore, a boost mode unit of a handheld power tool according to the disclosure is proposed.

Moreover, a method for operating a handheld power tool according to the disclosure in a boost mode of a boost mode unit is proposed.

The handheld power tool according to the disclosure should not be restricted here to the application and embodiment described above. In particular, the handheld power tool according to the disclosure may have a different number of individual elements, components and units than the number mentioned here to perform a functioning mode that is described here.

BRIEF DESCRIPTION OF THE DRAWINGS

Further advantages emerge from the following description of a drawing. In the drawing, three exemplary embodiments of the disclosure are represented. The drawing, the description and the claims contain numerous features in combination. A person skilled in the art will expediently also consider the features individually and put them together to form meaningful further combinations.

In the drawings.

DETAILED DESCRIPTION

Figure 1:
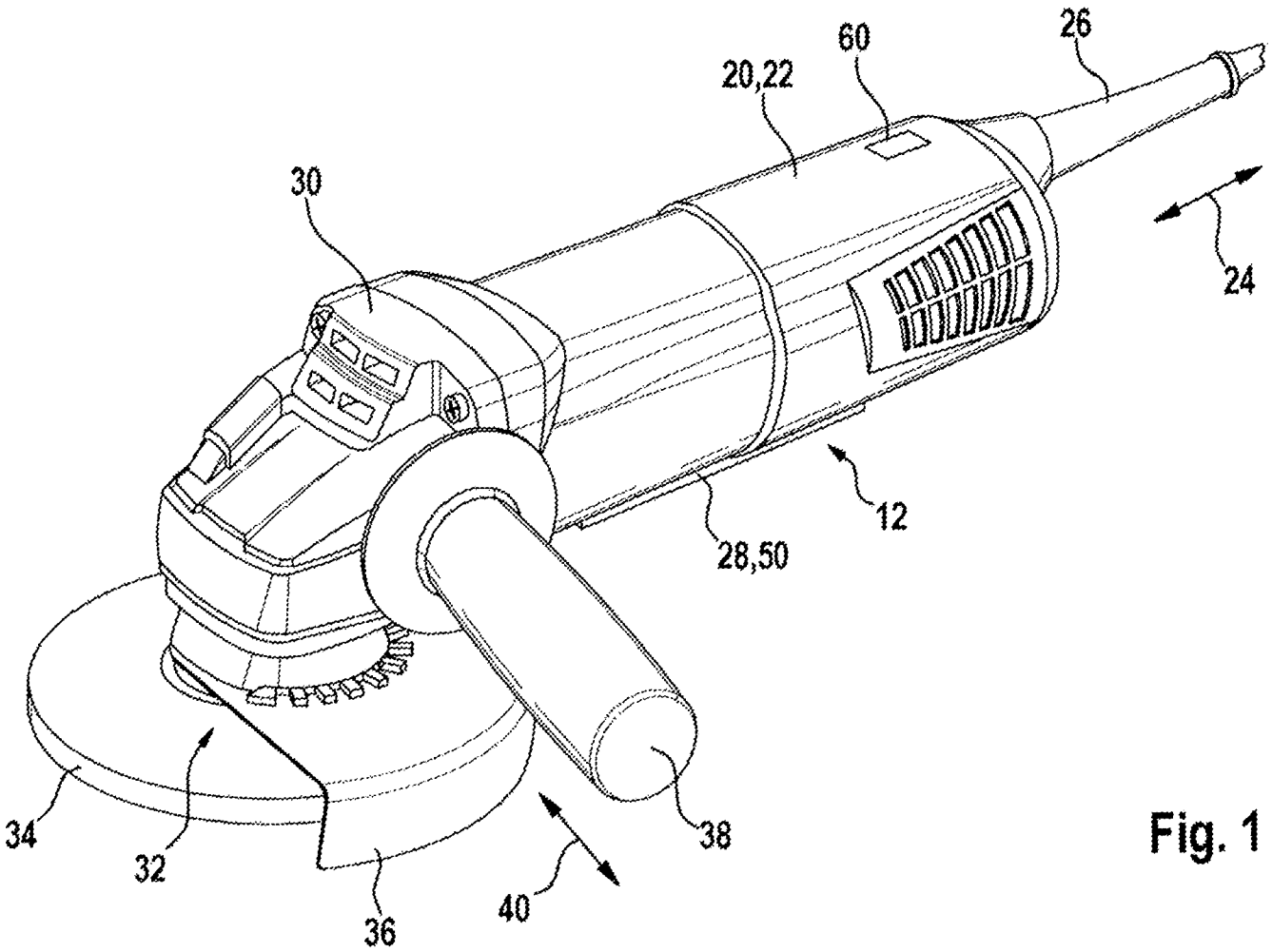
FIG. 1 shows a handheld power tool according to the disclosure in a schematic, perspective view.

In FIG. 1, a handheld power tool is represented. The handheld power tool is formed by an angle grinder. However, other configurations of the handheld power tool that appear appropriate to a person skilled in the are also conceivable, such as for example as a power drill, hammer drill, oscillating handheld power tool or orbital sander. The handheld power tool comprises a housing 20. The housing 20 is formed from a plastic. The housing 20 forms a main handle 22, which is intended for being grasped by a hand of an operator. When viewed in the main direction of extent 24 of the handheld power tool, a power cable 26 is arranged at one end of the housing 20. The power cable 26 is intended for supplying electrical power to a drive unit 18 of the handheld power tool. The power cable 26 is intended for being connected to an electrical power supply system. For this purpose, the power cable 26 has a plug element (not represented). However, it is also conceivable that the handheld power tool is formed by a battery-operated handheld power tool. The handheld power tool also has a switching element 28, which is formed such that it can be actuated by an operator. The switching element 28 is intended for activation of the drive unit 18. The switching element 28 is formed by a pawl.

The handheld power tool also has a transmission housing 30. The transmission housing 30 is connected to the housing 20 at an end of the housing 20 that is opposite from the power cable 26. The transmission housing 30 is formed from a metal. The transmission housing 30 is formed from aluminum. The handheld power tool comprises a tool holder 32 (not represented any more specifically), which is intended for receiving an insert tool 34 and captively holding it. The insert tool 34 is formed by a grinding disk. The insert tool 34 is detachably connected to the tool holder 32. When viewed perpendicularly to the main direction of extent 24 of the handheld power tool, the tool holder 32 is arranged at an open end of the transmission housing 30. The tool holder 32 protrudes out of the transmission housing 30. Moreover, a protective shroud 36 is coupled to the tool holder 32. The protective shroud 36 is detachably connected to the handheld power tool.

The handheld power tool also has an additional handle 38. The additional handle 38 is intended for being grasped by a further hand of the operator. The additional handle 38 is detachably coupled to the handheld power tool. In a state in which the additional handle 38 is mounted on the handheld power tool, a main direction of extent 40 of the additional handle 38 runs perpendicularly to the main direction of extent 24 of the handheld power tool and parallel to a main plane of extent of the insert tool 34.

Figure 2:
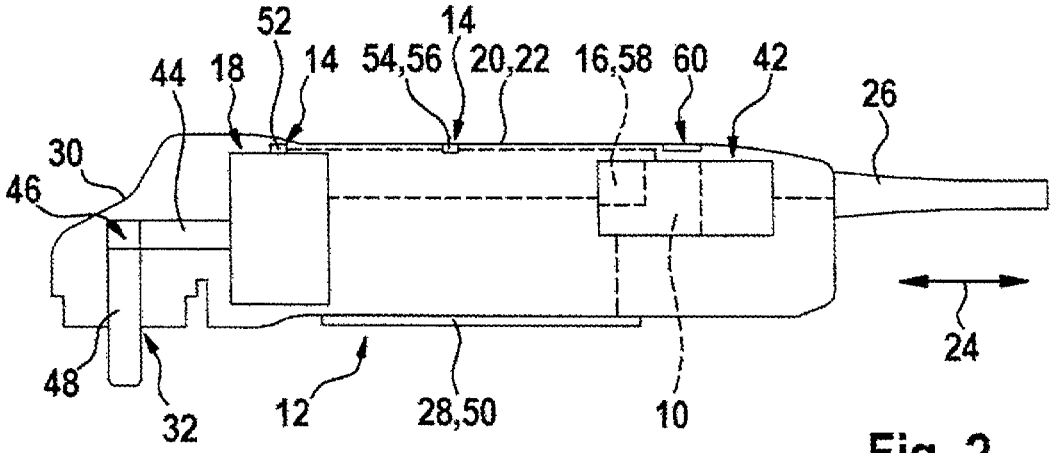
FIG. 2 shows the handheld power tool according to the disclosure in a schematic representation in a sectional view and FIG. 3 shows a diagram for the schematic representation of a power characteristic of the handheld power tool according to the disclosure.

The handheld power tool has the drive unit 18 and an electronics unit 42 (FIG. 2). The housing 20 of the handheld power tool encloses the drive unit 18 and the electronics unit 42. The drive unit 18 comprises an electric motor. The drive unit 18 comprises an EC motor. The drive unit 18 has a driven shaft 44, which is connected by way of a transmission unit 46 to a drive shaft 48. The transmission unit 46 has an angle-gear transmission (not represented). The drive shaft 48 is intended for driving an insert tool 34 (not represented here), which is coupled to the tool holder 32. The drive shaft 48 is connected to the tool holder 32. The drive shaft 48 is coupled to the tool holder 32 with positive and/or non-positive engagement. The drive shaft 48 extends perpendicularly to the driven shaft 44. The drive shaft 48 runs perpendicularly to the main direction of extent 24 of the handheld power tool.

The drive unit 18 is operatively connected to the electronics unit 46. The drive unit 18 is connected to the electronics unit 42 electronically. The electronics unit 42 is intended for open-loop or closed-loop control of the drive unit 18. The electronics unit 42 may alternatively or additionally also be intended for open-loop or closed-open loop control of a further functional unit that appears appropriate to a person skilled in the art. The electronics unit 42 comprises field-effect transistors. The electronics unit 42 comprises metal-oxide semiconductor field-effect transistors (MOSFETs). Alternatively or additionally, the electronics unit 42 may also comprise other electronic components that appear appropriate to a person skilled in the art, such as for example a bipolar transistor with an insulated gate electrode (IGBT).

The handheld power tool comprises a boost mode unit 10, which is intended for providing a boost mode. The boost mode unit 10 is formed in one piece with the electronics unit 42. The electronics unit 42 is intended also for making a conventional mode available. The handheld power tool has a switching-over unit 12, which is intended for switching over between the conventional mode and the boost mode. The switching-over unit 12 comprises a switching-over element 50 that can be actuated by an operator. The switching-over element 50 is formed by a pawl. The switching-over element 50 is formed in one piece with the switching element 28. However, it is also conceivable that the switching-over unit 12 is intended for an autonomous switching over between the conventional mode and the boost mode that is independent of an operator.

The handheld power tool has a sensor unit 14, which is intended for sensing an operating parameter in the boost mode. The sensor unit 14 is intended for sensing a number of operating parameters in the boost mode. The sensor unit 14 is coupled to the boost mode unit 10. The sensor unit 14 is coupled to the boost mode unit 10 electronically. The sensor unit 14 is intended for directly sensing the operating parameters to be sensed. However, it is also conceivable that the sensor unit 14 is intended for indirectly determining the operating parameters to be sensed, such as for example by an evaluation, conversion and/or extrapolation of values of adjacent components and/or indirect measurements.

The sensor unit 14 comprises one or more sensor elements. A first sensor element 52 is intended for sensing a temperature of the drive unit 18. Alternatively or additionally, it is also conceivable that the sensor unit 14 is intended for sensing a temperature of the electronics unit 42 and/or some other functional unit of the handheld power tool that appears appropriate to a person skilled in the art, such as for example output stages, transistors or a motor winding. The first sensor element 52 is formed as a temperature sensor. The sensor unit 14 comprises a further sensor element 54, which is intended for sensing a time parameter. The further sensor element 54 comprises a time sensing element 56. The time sensing element 56 is intended for sensing a period in which the handheld power tool is operated in a boost mode. Furthermore, the time sensing element 56 is intended for sensing a period since the handheld power tool was operated in a boost mode. However, it is also conceivable that the sensor unit 14 is intended for sensing a rotational speed and/or a power take-up of the drive unit 18 and/or some other operating parameter of the handheld power tool that appears appropriate to a person skilled in the art.

The boost mode unit 10 comprises an open-loop and/or closed-loop control unit 16, which is intended for open-loop and/or closed-loop control of the drive unit 18. The open-loop and/or closed-loop control unit 16 is formed as an open-loop control unit 58, which is intended for open-loop control of the drive unit 18. Alternatively or additionally, it is also conceivable that the open-loop and/or closed-loop control unit 16 is formed as a closed-loop control unit, which is intended for closed-loop control of the drive unit 18. The open-loop control unit 58 is intended for controlling the boost mode unit 10 in an open-loop manner in dependence on the operating parameter formed by the temperature of the drive unit 18. The open-loop control unit 58 is also intended for controlling the boost mode unit 10 in an open-loop manner in dependence on the further operating parameter sensed by the time sensing element 56.

The handheld power tool also comprises the switching-over unit 12, which is intended for switching over between a conventional mode and a boost mode in an operating state of the handheld power tool. The switching-over unit 12 comprises a switching-over element 50, which is intended for switching over between a conventional mode and a boost mode in an operating state of the handheld power tool. The switching-over element 50 is formed in one piece with the switching element 28. However, it is also conceivable that the switching-over element 50 is formed separately from the switching element 28 and/or is formed as a switching slide or in some other way that appears appropriate to a person skilled in the art. The switching element 28 has a first switching position, which is reached by an operator pressing the switching element 28 formed by the pawl toward the housing 20 of the handheld power tool. The switching-over element 50 and the switching element 28 are coupled to the electronics unit 42. When the switching element 28 is actuated by an operator, the drive unit 18 is activated by way of the electronics unit 42 and the handheld power tool is put into an operating state.

Figure 3:
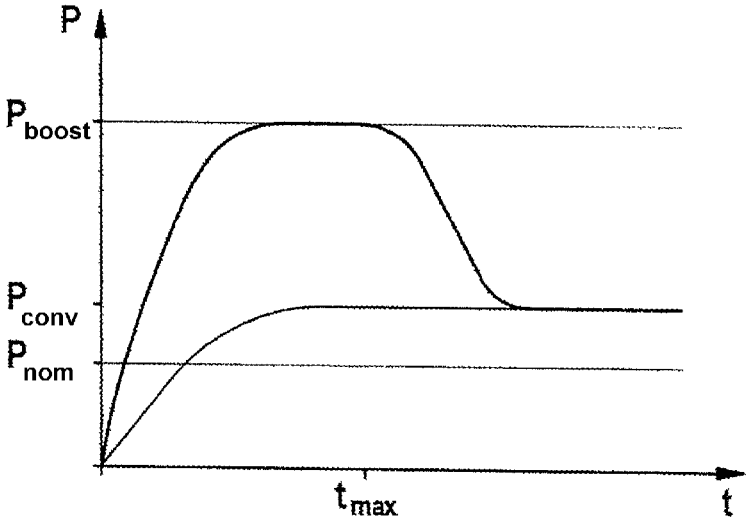

In this first switching position of the switching element 28, the handheld power tool works in a conventional operating mode. The electronics unit 42 thereby activates the drive unit 18 in such a way that a motor power output $P_{conv}$ of the drive unit 18 in the operating state is in the range of a nominal power output $P_{nom}$ (FIG. 3). By the operator pressing the switching element 28 with increased expenditure of force, the switching element 28 can be brought into a further switching position. In this further switching position of the switching element 28, the handheld power tool works in a boost mode. The electronics unit 42 thereby activates the drive unit 18 in such a way that a motor power output $P_{boost}$ of the drive unit 18 in the boost mode is higher than the motor power output $P_{conv}$ in a conventional operating mode. The motor power output $P_{boost}$ of the drive unit 18 in the boost mode significantly exceeds the nominal power output $P_{nom}$. The motor power output $P_{boost}$ of the drive unit 18 in the boost mode is about 150% of the nominal power output $P_{nom}$. Alternatively or additionally, it is also conceivable that the motor power output $P_{boost}$ of the drive unit 18 in the boost mode is for a short time about 180% of the nominal power output $P_{nom}$.

An operating period of the handheld power tool in boost mode is limited, so that premature wearing of the handheld power tool can be limited or prevented. For this, in the boost mode the first sensor element 52 of the sensor unit 14 senses the temperature of the drive unit 18. The sensed values of the first sensor element 52 of the sensor unit 14 are passed on to the open-loop control unit 58 of the boost mode unit 10. Here, the sensed values are compared with prescribed limit values. If the sensed values, and consequently the temperature of the drive unit 18, exceed the limit values, the boost mode is ended, in order to prevent the drive unit 18 from being damaged by overheating. Moreover, the further sensor element 54 of the sensor unit 14 senses a period in which the handheld power tool is operated in the boost mode. If a prescribed maximum period $t_{max}$, which is stored in the open-loop control unit 58, is exceeded without the boost mode having been ended on account of the temperature exceeding the limit, the boost mode is automatically ended. As a result, damage to the drive unit 18 can be dependably prevented.

The further sensor element 54 of the sensor unit 14 is also intended for sensing a period that has elapsed since the ending of the boost mode. This value is passed on to the open-loop control unit 58 and compared with a prescribed value stored in the open-loop control unit 58. If the sensed value goes below the prescribed value, renewed activation of the boost mode is blocked by the open-loop control unit 58 and is consequently not possible. Only after the elapse of a minimum period that must have elapsed after operating the handheld power tool in the boost mode can the boost mode be activated once again by the operator.

Once the boost mode has been automatically ended by the open-loop control unit 58 on account of the maximum temperature of the drive unit 18 being exceeded or on account of the prescribed maximum period of time $t_{max}$ being exceeded, the handheld power tool continues to run in the conventional operating mode even in the further switching position of the switching element 28. The operator can of its own accord change from the boost mode into the conventional operating mode, in that the operator brings the switching element 28 from the further switching position into the first switching position by reducing the force expended.

However, it is also conceivable that the power characteristic of the drive unit 18 in the boost mode can be dynamically adapted in dependence on the temperature of the drive unit 18 sensed by the first sensor element 52. For example, the motor power output $P_{boost}$ in the boost mode may be thereby reduced as the temperature of the drive unit 18 increases. Furthermore, it is also conceivable to increase a cooling power output of a cooling unit (not represented) of the handheld power tool during operation of the handheld power tool in a boost mode, in order to slow down or counteract a rise in temperature due to the increased power take-up of the drive unit 18.

The handheld power tool also has an information unit 60, which is intended for informing an operator of the handheld power tool about an operating mode of the handheld power tool in an operating state. The information unit 60 is coupled to the electronics unit 42. The information unit 60 is coupled to the electronics unit 42 electronically. The information unit 60 is incorporated in the housing 20. The information unit 60 is intended for emitting an optical signal that can be perceived by an operator. However, it is also conceivable that the information unit 60 is intended for emitting an acoustic and/or haptic signal that can be perceived by an operator. The information unit 60 is formed by a display. However, it is also conceivable that the information unit 60 is formed as an LED, loudspeaker and/or in some other way that appears appropriate to a person skilled in the art. The information unit 60 is intended for informing an operator about a remaining maximum period of time that is left to use the boost mode or about a period of time that is left until the next-possible time at which the boost mode can be activated once again.

What is claimed is:

1. An angle grinder, comprising:

a drive unit including a drive shaft;

a switching-over unit configured to be moved by an operator to a first switching position and a further switching position;

a control unit coupled to the drive unit and the switching-over unit, the control unit being configured to activate the drive unit in a conventional mode when the switching-over unit is in the first switching position and to activate the drive unit in a boost mode when the switching over-unit is in the further switching position, wherein, in the conventional mode, the control unit activates the drive unit such that a maximum power output of the drive unit corresponds to a first maximum power output, the first maximum power output being at most 120% of a nominal power output of the drive unit, wherein, in the boost mood, the control unit activates the drive unit such that the maximum power output of the drive unit corresponds to a second maximum power output, the second maximum power output being greater than the first maximum power output and at most 180% of the nominal power output of the drive unit, and wherein the control unit is configured to return the drive unit to the conventional mode when the switching-over unit is in the further switching position after the drive unit is operated in the boost mode for a predetermined duration.

2. The angle grinder according to claim 1, further comprising:

a sensor unit configured to sense an operating parameter of the drive unit at least in the boost mode, and wherein the control unit is coupled to the sensor unit and is configured to return the drive unit to the conventional mode when the operating parameter sensed by the sensor unit while the drive unit is in the boost mode exceeds a limit value.

3. The angle grinder according to claim 2, wherein the sensor unit is at least partially coupled to the at least one boost mode unit.

4. The angle grinder according to claim 2, wherein the control unit comprises an open-loop control unit configured for open-loop control of the drive unit.

5. The angle grinder according to claim 4, wherein the open-loop control unit is configured to control the drive unit in an open-loop manner at least in dependence on the operating parameter sensed by the sensor unit.

6. The angle grinder according to claim 4, wherein the drive unit includes at least one EC motor.

* * * * *